US007794332B2

(12) United States Patent
Johnson

(10) Patent No.: US 7,794,332 B2
(45) Date of Patent: Sep. 14, 2010

(54) VISUAL AND TACTILE CONFIRMATION GOLF GRIP AND SYSTEM

(76) Inventor: Lanny L. Johnson, 7381 Almaden La., Carlsbad, CA (US) 92009

( * ) Notice: Subject to any disclaimer, the term of this patent is extended or adjusted under 35 U.S.C. 154(b) by 0 days.

(21) Appl. No.: 12/609,322

(22) Filed: Oct. 30, 2009

(65) Prior Publication Data

US 2010/0048319 A1 Feb. 25, 2010

Related U.S. Application Data

(62) Division of application No. 12/236,650, filed on Sep. 24, 2008, now Pat. No. 7,637,821.

(60) Provisional application No. 60/974,705, filed on Sep. 24, 2007.

(51) Int. Cl.
*A63B 53/14* (2006.01)

(52) U.S. Cl. ..... 473/303; 473/202

(58) Field of Classification Search ..... 473/300–303, 473/202
See application file for complete search history.

(56) References Cited

U.S. PATENT DOCUMENTS

| | | | | | |
|---|---|---|---|---|---|
| 834,711 | A | * | 10/1906 | Clarke | 473/303 |
| 1,556,781 | A | * | 10/1925 | Gjorup | 473/302 |
| 2,166,044 | A | * | 7/1939 | Fletcher | 473/551 |
| D128,266 | S | * | 7/1941 | Smith | D21/756 |
| D172,416 | S | * | 6/1954 | Brandon | D21/756 |
| D174,183 | S | | 3/1955 | Karns | |
| 3,109,653 | A | | 11/1963 | Biggs | |
| 3,706,453 | A | * | 12/1972 | Rosasco, Jr. | 473/203 |
| 4,466,610 | A | | 8/1984 | Israel | |
| 4,537,403 | A | | 8/1985 | Farina | |
| D295,207 | S | * | 4/1988 | Mahaffey | D21/756 |
| 4,795,158 | A | | 1/1989 | Kuykendall | |
| D307,169 | S | | 4/1990 | Aldridge | |
| 4,919,420 | A | * | 4/1990 | Sato | 473/203 |
| 4,932,659 | A | | 6/1990 | Freeberg | |
| 5,087,042 | A | * | 2/1992 | Solheim | 473/303 |
| 5,133,555 | A | | 7/1992 | Bailey | |
| 5,158,297 | A | | 10/1992 | Johnson | |
| 5,248,141 | A | * | 9/1993 | Kelly | 473/303 |
| D345,192 | S | * | 3/1994 | Solheim | D21/756 |
| 5,575,724 | A | | 11/1996 | Hannon et al. | |

(Continued)

FOREIGN PATENT DOCUMENTS

EP 1452208 A1 9/2004

*Primary Examiner*—Stephen L. Blau
(74) *Attorney, Agent, or Firm*—Michael J. Gallagher; David J. Dawsey; Gallagher & Dawsey Co., LPA

(57) ABSTRACT

A visual and tactile confirmation golf grip and system is provided. The golf grip may include an alignment channel, an alignment projection, or combinations thereof extending along an anterior surface of the golf grip, a posterior surface of the golf grip, a side surface of the golf grip, or combinations thereof. The alignment channel and the alignment projection are designed and configured to provide a visual and tactile indication as to whether the golf grip is in the proper, or intended, orientation with respect to a golf club face. The system includes a golf grip and an alignment device. The alignment device is releasably secured to the golf grip and includes a feedback element. The feedback element provides an indication as to whether the golf grip is in a desired position with respect to the golf club face.

6 Claims, 11 Drawing Sheets

U.S. PATENT DOCUMENTS

D376,400 S * 12/1996 Nakazaki ..... D21/756
5,590,437 A * 1/1997 McMillin ..... 15/143.1
5,637,043 A 6/1997 Fortis
D391,330 S * 2/1998 Solheim et al. ..... D21/756
5,788,582 A 8/1998 Shapiro
5,788,588 A 8/1998 Hooker
D431,851 S * 10/2000 Anderson ..... D21/756
D435,074 S * 12/2000 Dunham ..... D21/757
6,605,005 B1 8/2003 Lin
6,656,054 B2 12/2003 Ulrich
6,758,760 B1 7/2004 Kellogg et al.
6,840,869 B2 1/2005 Chen
6,908,400 B2 * 6/2005 Chu et al. ..... 473/303
6,921,340 B2 7/2005 Dickie
D512,758 S * 12/2005 Tuerschmann et al. ..... D21/756
7,175,538 B2 * 2/2007 Miller ..... 473/300
D548,807 S * 8/2007 Miller ..... D21/756
D548,808 S * 8/2007 Chen ..... D21/756
7,537,525 B2 5/2009 Wang
2004/0259655 A1 12/2004 Ferris
2005/0026712 A1 2/2005 Byrd et al.
2005/0187030 A1 * 8/2005 Miller ..... 473/300
2006/0068148 A1 * 3/2006 Ulrich ..... 428/41.8
2006/0287124 A1 * 12/2006 Han et al. ..... 473/300
2007/0082748 A1 4/2007 Rose
2007/0259732 A1 * 11/2007 Billings et al. ..... 473/303
2008/0102974 A1 * 5/2008 Nam et al. ..... 473/300
2008/0230174 A1 * 9/2008 Huang ..... 156/187
2009/0017935 A1 * 1/2009 Wang et al. ..... 473/300
2009/0023512 A1 * 1/2009 Watson ..... 473/303
2009/0082122 A1 3/2009 Kellogg

* cited by examiner

VISUAL AND TACTILE CONFIRMATION GOLF GRIP AND SYSTEM

CROSS REFERENCE TO RELATED APPLICATIONS

This application is a divisional application of U.S. application Ser. No. 12/236,650 filed Sep. 24, 2008, now U.S. Pat. No. 7,637,821 which claims the benefit of U.S. Provisional Application No. 60/974,705, filed Sep. 24, 2007.

TECHNICAL FIELD

The instant invention relates to the field of sports equipment, and more particularly, to a visual and tactile confirmation golf grip and system.

BACKGROUND OF THE INVENTION

Perhaps one of the most important fundamental skills in the game of golf is the ability to properly align the golf club face to the intended target. This skill is extremely critical when it comes to the aspect of the game referred to as putting. When putting, a slight misalignment of the golf club face can result in missing a putt by several inches or more. The same holds true for shots made with irons and woods.

Compounding the problem of alignment is the fact that golf grips are not always applied to golf clubs with the proper orientation with respect to the golf club face. Golf grips are often difficult to apply with the correct intended orientation. This difficulty is due, in part, to the viscoelastic nature of the grip material, which makes the grip subject to rotational deformity during and after application. However, much of the inaccuracy in grip alignment stems from the fact that most golf grips are applied by "eyeballing" the orientation of the grip with respect to the golf club face.

When misaligned, the golf grip creates a potential error in shot direction. This is due to the fact that a golfer will often trust that the golf grip was applied with the proper orientation with respect to the golf club face. Trusting that the golf grip was applied properly, especially when the golf grip includes a "reminder," the golfer will grasp the golf grip in accordance with the "reminder" and believe that the golf club face is properly aligned. However, if the golf grip is misaligned, then the golfer will likely be addressing the golf ball with an open or closed golf club face, which results in an error in shot direction.

The orientation of a golf club in space is dependent upon visual and palpation sense. Golf is in part a hand-eye coordination sport, but more than that it is a sport that requires spatial relationships relative to the body's motion in performing the golf swing. One of the inherent body functions is that which is known as proprioception. Proprioception is the ability to sense where any given body part is in relation to other body parts.

There is one other anatomical and physical property in the human body that assists in determining position. This is known as sensibility; the body's ability to determine fine objects by feel. This ability is measured by what is known as two-point discrimination. Two-point discrimination is defined as the ability to discern that two nearby objects touching the skin are truly two distinct points, not one. The test for two-point discrimination is usually performed utilizing two sharp points. Typically, a person has the most sensibility on their finger pads and lips. A normal measurement for two-point discrimination on the finger pads and lips ranges from about 2 to 5 millimeters, while other body parts, such as the back, have a normal two-point discrimination ranging from 30 to 40 millimeters. When the two points are closer together than the range of two-point discrimination a person cannot tell whether they are being contacted by one point or two points.

Motor memory is another important aspect of making a repeatable, consistent golf stroke. A golfer's sense of sight and touch play an important role in the golf swing. In the case of a golf swing, motor memory is very dependent upon tactile sensibility for spatial relationships.

There still remains a need for a golf grip and alignment system to confirm that the golf grip was applied with the desired orientation and that this orientation is maintained throughout the life of the golf grip. Specifically, there remains a need for a visual and tactile confirmation golf grip and alignment system that recognizes and utilizes the body's innate abilities of proprioception and sensibility by two-point discrimination.

SUMMARY OF INVENTION

In its most general configuration, the present invention advances the state of the art with a variety of new capabilities and overcomes many of the shortcomings of prior devices in new and novel ways. The present invention overcomes the shortcomings and limitations of the prior art in any of a number of generally effective configurations. The instant invention demonstrates such capabilities and overcomes many of the shortcomings of prior methods in new and novel ways.

The present invention is a visual and tactile confirmation golf grip and system. The golf grip and system are configured such that the golf grip is capable of precise installation in a predetermined orientation with respect to a golf club face.

In one embodiment, the visual and tactile confirmation golf grip includes an alignment channel. The alignment channel may extend longitudinally along the golf grip's anterior or posterior surface. The alignment channel is defined by a channel bottom wall, a channel dextral sidewall, and a channel sinistral sidewall. The alignment channel is sized and dimensioned to accommodate two-point discrimination, and thus allow a golfer to determine by tactile perception the orientation of the golf grip with respect to the golf club face. Additionally, the alignment channel is configured to provide a golfer with visual feedback regarding the alignment of the golf grip with respect to the golf club face.

In another embodiment, the visual and tactile confirmation golf grip includes an alignment projection. The alignment projection may extend longitudinally along the golf grip's anterior or posterior surface. The alignment projection is defined by a projection top wall, a projection dextral sidewall, and a projection sinistral sidewall. The alignment projection is sized and dimensioned to accommodate two-point discrimination, and thus allow a golfer to determine by tactile perception the orientation of the golf grip with respect to the golf club face. Additionally, the alignment projection is configured to provide a golfer with visual feedback regarding the alignment of the golf grip with respect to the golf club face. Moreover, the alignment projection may also perform a "reminder" function so that the golfer will know whether they are grasping the golf grip with the proper hand and finger placement.

The system according to the instant invention generally includes a golf grip and an alignment device. The alignment device is joined to the golf grip and includes a feedback element. The feedback element projects along a straight line, and thus provides an indication of the alignment of the golf grip with respect to the golf club face. In one particular embodiment, the feedback element is a focused beam of laser light.

BRIEF DESCRIPTION OF THE DRAWINGS

Without limiting the scope of the present invention as claimed below and referring now to the drawings and figures:

Figure 1:
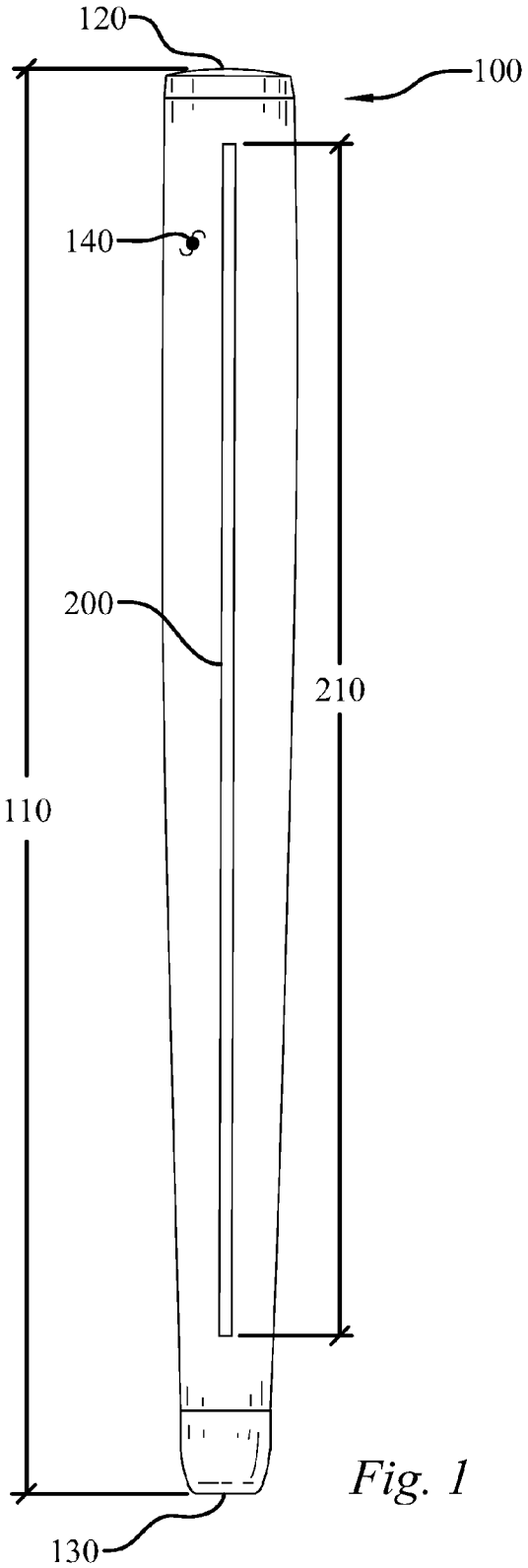
FIG. 1 is a front elevation view of an embodiment of a golf grip according to the present invention, not to scale.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

A visual and tactile confirmation golf grip (100) and system of the instant invention enables a significant advance in the state of the art. The preferred embodiments of the device and system accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

With reference generally to FIGS. 1-18, the present invention relates to a visual and tactile confirmation golf grip (100) and system. The golf grip (100) provides visual and tactile confirmation that the golf grip (100) is aligned in a predetermined orientation with respect to a golf club face (10). The system generally includes the golf grip (100) and an alignment device (400). Before turning to the particular aspects of the system, the golf grip (100) according to the present invention will be described in detail.

Figure 2:
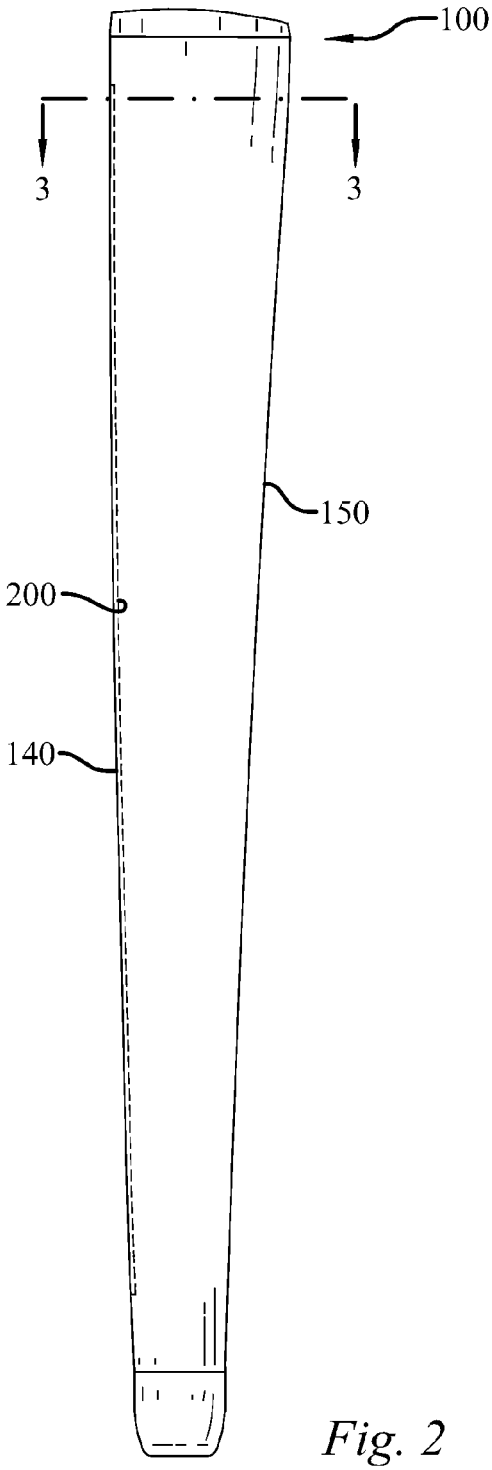
FIG. 2 is a side elevation view of an embodiment of a golf grip according to the present invention, not to scale.

Referring now to FIGS. 1 and 2, an embodiment of a visual and tactile confirmation golf grip (100) according to the present invention is illustrated. The golf grip (100) generally has a grip length (110), a proximal end (120), a distal end (130), an anterior surface (140), and a posterior surface (150). It should be noted that the anterior surface (140) refers to the surface of a golf grip (100) that has been applied to a golf club that faces away from a golfer when the golf club is soled on a playing surface. The posterior surface (150) is directly opposite the anterior surface (140), and thus would face towards a golfer. For a golfer using a conventional grip, the golfer's thumbs will be positioned proximal to the anterior surface (140) of the golf grip (100) and the golfer's fingers will be wrapped around the posterior surface (150).

Under the current rules of golf, as administered by the United States Golf Association and the Royal and Ancient Golf Club of St Andrews, the golf grip (100) must have a circular cross-section, unless the golf grip (100) is used on a putter type golf club. As shown throughout the drawings, the golf grip (100) of the present invention is depicted as having a flat anterior surface (140), and thus a non-circular cross-section, which is suitable for use on a putter type golf club. However, the golf grip (100) of the present invention may be constructed with both circular and non-circular cross-sections such that the golf grip (100) conforms to the rules of golf when used on any of the various types of golf clubs.

Still referring to FIG. 1, in one particular embodiment, the golf grip (100) includes an alignment channel (200). The alignment channel (200) extends longitudinally along the anterior surface (140), preferably along the longitudinal center of the anterior surface (140), a predetermined channel length (210). The alignment channel (200) also has a channel width (220) and a channel depth (230), as best seen in FIG. 3.

Figure 3:
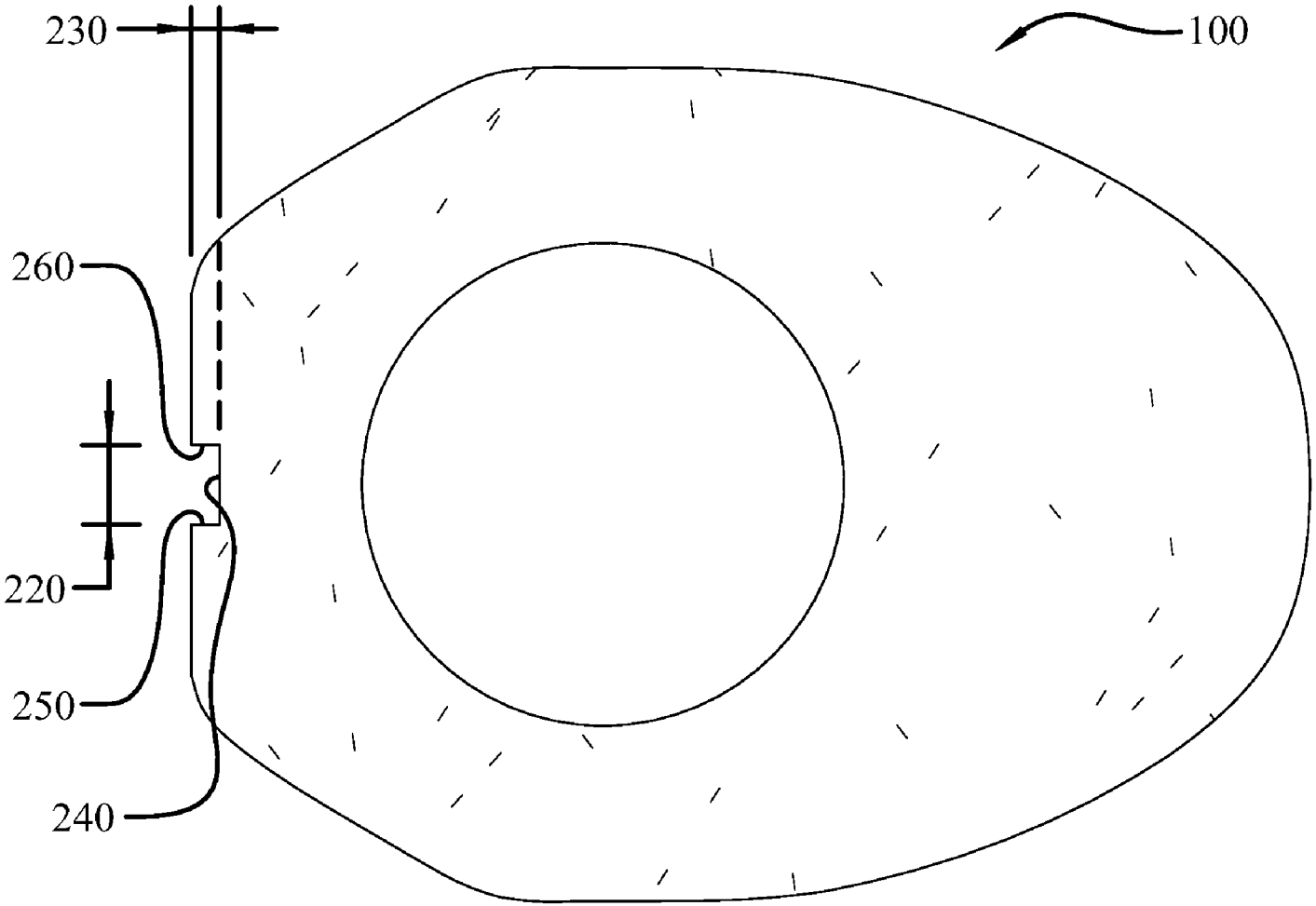
FIG. 3 is a cross-sectional view of the golf grip taken along section line 3-3 of FIG. 2, not to scale.
Figure 4:
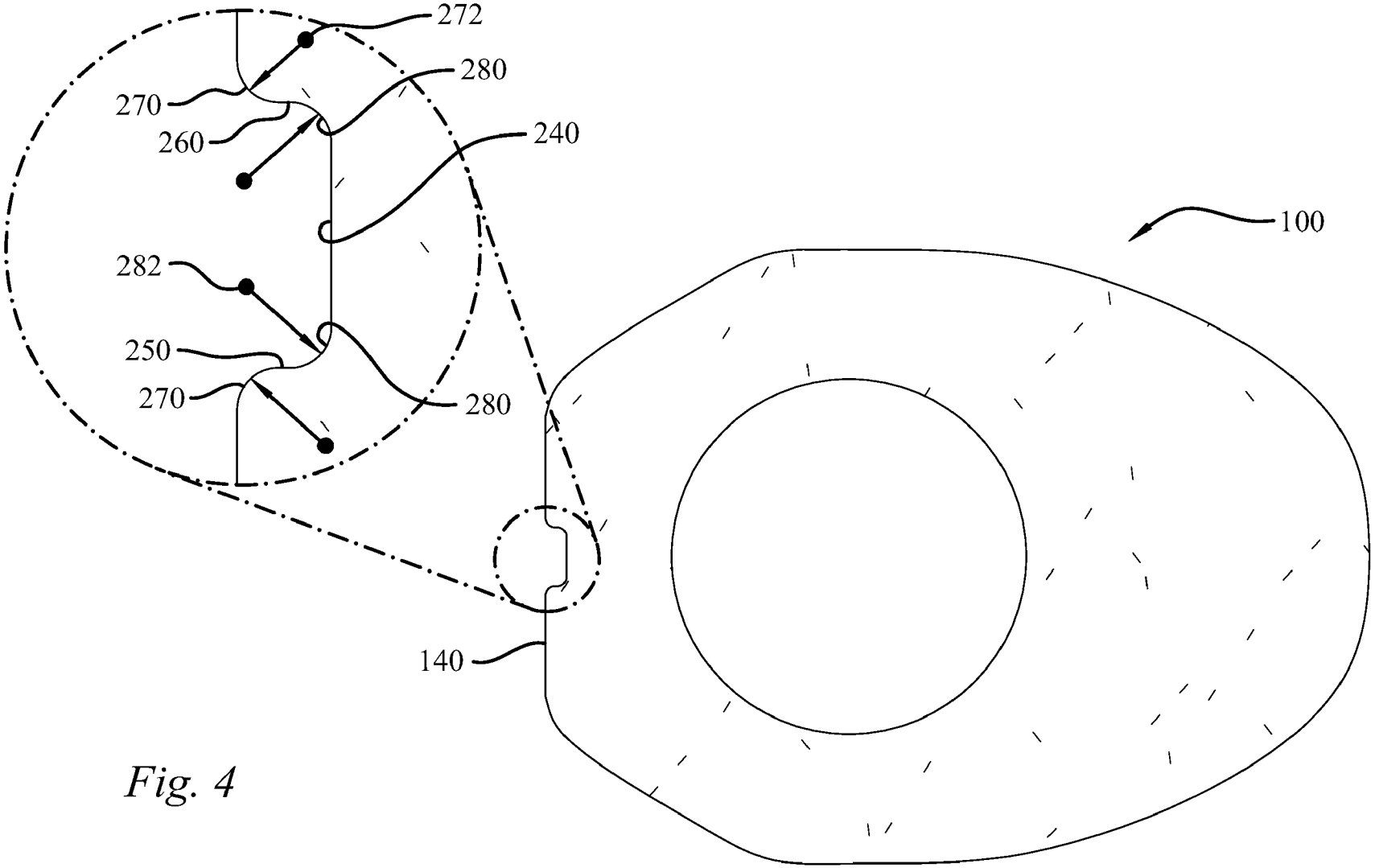
FIG. 4 is a cross-sectional view of an embodiment of a golf grip according to the present invention, not to scale.

Referring to FIG. 3, the alignment channel (200) is defined by a channel bottom wall (240), a channel dextral sidewall (250), and a channel sinistral sidewall (260). As seen in FIG. 4, the channel dextral sidewall (250) and the channel sinistral sidewall (260) are each joined to the anterior surface (140) by an upper channel transition region (270) having an upper channel transition region radius of curvature (272). Similarly, the channel dextral sidewall (250) and the channel sinistral sidewall (260) are each joined to the channel bottom wall (240) by a lower channel transition region (280) having a lower channel transition region radius of curvature (282).

In one particular embodiment, the channel width (220) is at least 1.5 millimeters, and the channel depth (230) is at least 0.5 millimeters. Such dimensions accommodate two-point discrimination, and thus allow a golfer to determine by tactile perception the orientation of the golf grip (100) with respect to the golf club face (10). This feature is especially helpful when applying a golf grip (100) to a golf club as a way to confirm by feel that the golf grip (100) is free of rotational deformities, which is difficult to perceive by "eyeballing."

In another embodiment, the channel width (220) may between 1.5 millimeters and 3.0 millimeters, and the channel depth (230) may be between 0.5 millimeter and 1.0 millimeter. Such dimensions accommodate two-point discrimination, which enables a golfer to determine by tactile perception the orientation of the golf grip (100) with respect to the golf club face (10), yet are not so large as to be distracting.

Because the alignment channel (200) is configured and dimensioned to provide instant feedback as to whether the golf grip (100) is positioned correctly with respect to the golf club face (10), a golfer using the golf grip (100) will have more confidence when making a golf shot. Additionally, the feedback provided by the alignment channel (200) will instantly alert the golfer if the golf grip (100) ever becomes misaligned with respect to the golf club face (10).

Along similar lines, the upper channel transition region (270) and the upper channel transition region radius of curvature (272) also contribute to the ability of determining by tactile perception whether the golf grip (100) is accurately oriented with respect to the golf club face (10). In one embodiment, the upper channel transition region radius of curvature (272) is 0.35 millimeters or less. Such a dimension for the upper channel transition region radius of curvature (272) accommodates two-point discrimination by making the upper channel transition region (270) relatively fine and thus capable of distinction by feel. Preferably, the upper and lower channel transition region radius of curvature (272, 282) are equal to zero, which corresponds to the channel dextral and sinistral sidewalls (250, 260) each joining the anterior surface (140) at a 90 degree angle, and the channel dextral and sinistral sidewalls (250, 260) each joining the channel bottom wall (240) at a 90 degree angle. This specific embodiment provides a pair of distinct sharp edges along the anterior surface (140) that allows a golfer to confirm by feel whether the golf grip (100) is properly oriented with respect to the golf club face (10).

In addition to confirming by feel that the golf grip (100) is properly oriented with respect to the golf club face (10), the alignment channel (200) also provides a visual indication that the golf grip (100) is properly aligned. For example, in one embodiment, the channel bottom wall (240) may include visual indicia to distinguish the alignment channel (200) from the remainder of the golf grip (100). By way of example, and not limitation, the indicia may be a paint color that contrasts with the overall color of the grip, nylon sparkles, or a strip of reflective material.

In another embodiment, the channel dextral sidewall (250) and the channel sinistral sidewall (260) may include visual indicia. By way of example, and not limitation, the visual indicia may be bright paint colors that contrast with the overall color of the grip, nylon sparkles, or a strip of reflective material. The visual indicia on the channel dextral and sinistral sidewalls (250, 260) may function as a visual indicator and as a training aid. As a visual indicator, the visual indicia on the channel dextral and sinistral sidewalls (250, 260) provides visual feedback regarding whether the golf grip (100) is aligned with the golf club face (10) and whether the golf grip (100) is free of any rotational deformities. For example, if the golf grip (100) has a rotational deformity, a portion of the channel dextral or sinistral sidewall (250, 260) may be visible when looking down the golf grip (100) from a top view.

Moreover, the visual indicia may also be utilized as a training aid. For example, when addressing a golf ball, a golfer may look down at the golf grip (100) to determine whether they have assumed a correct posture and have soled the golf club correctly. If the channel dextral and sinsitral sidewalls (250, 260) are visible, then the golfer may make adjustments to correct their posture and how the golf club is soled. When the channel dextral and sinistral sidewalls (250, 260) are no longer visible, then the golfer will know that they are addressing the golf ball correctly and will make their stroke with more confidence.

Additionally, the alignment channel (200) may perform a "reminder" function. For example, when the golf grip (100) is applied in a precise manner with respect to the golf club face (10), a golfer will be able to feel the alignment channel (200) and know whether they are grasping the golf grip (100) with the proper hand and finger placement such that the golf club face (10) is properly aligned. The combination of knowing that the golf grip (100) was precisely aligned and the ability to perceive by feel that the golf grip (100) has been grasped correctly creates a higher level of psychomotor confidence in the golfer, which results in a better golf stroke.

In yet another embodiment of the instant invention, the channel length (210) is at least 50 percent of the grip length (110). Having the alignment channel (200) extend along at least 50 percent of the grip length (110) allows a golfer to determine, both visually and by feel, whether the golf grip (100) is at the desired orientation with respect to the golf club face (10), and especially whether the proximal end (120) and the distal end (130) are aligned and free of rotational deformity. Providing a shorter channel length (210) would allow for a greater possibility of optical illusion or misinterpretation when visually determining if the golf grip (100) is properly aligned. Additionally, a shorter channel length (210) would not provide an accurate indication as to the alignment of the proximal end (120) and the distal end (130) of the golf grip (100), and thus the installed golf grip (100) may have a rotational deformity.

Moreover, an alignment channel (200) that extends along at least 50 percent of the grip length (110) accommodates the numerous styles of hand positioning and gripping used to grasp a golf club, including, but not limited to, a conventional grip, a claw type grip, or a saw type grip. Such a channel length (210) allows a golfer to always have both hands in contact with the alignment channel (200) to receive maximum feedback.

Figure 14:
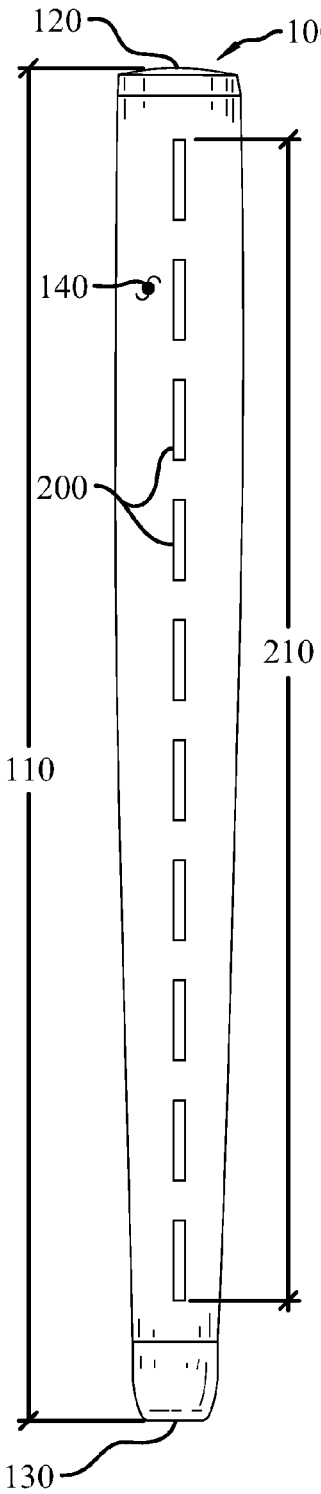
FIG. 14 is a front elevation view of an embodiment of a golf grip according to the present invention, not to scale.

In addition, the alignment channel (200) may comprise two or more non-continuous channels, as seen in FIG. 14. The non-continuous channels may be strategically positioned on the golf grip (100) to coincide with the portions of the golf grip (100) most likely to be contacted by the golfer.

Figure 5:
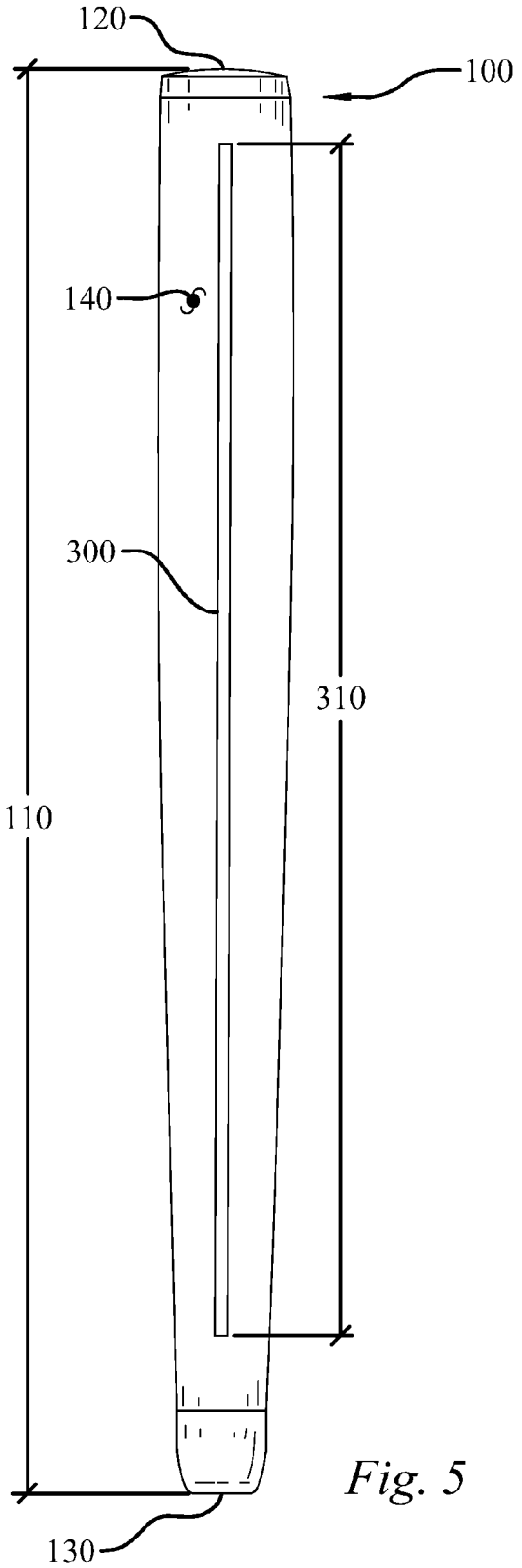
FIG. 5 is a front elevation view of an embodiment of a golf grip according to the present invention, not to scale.
Figure 6:
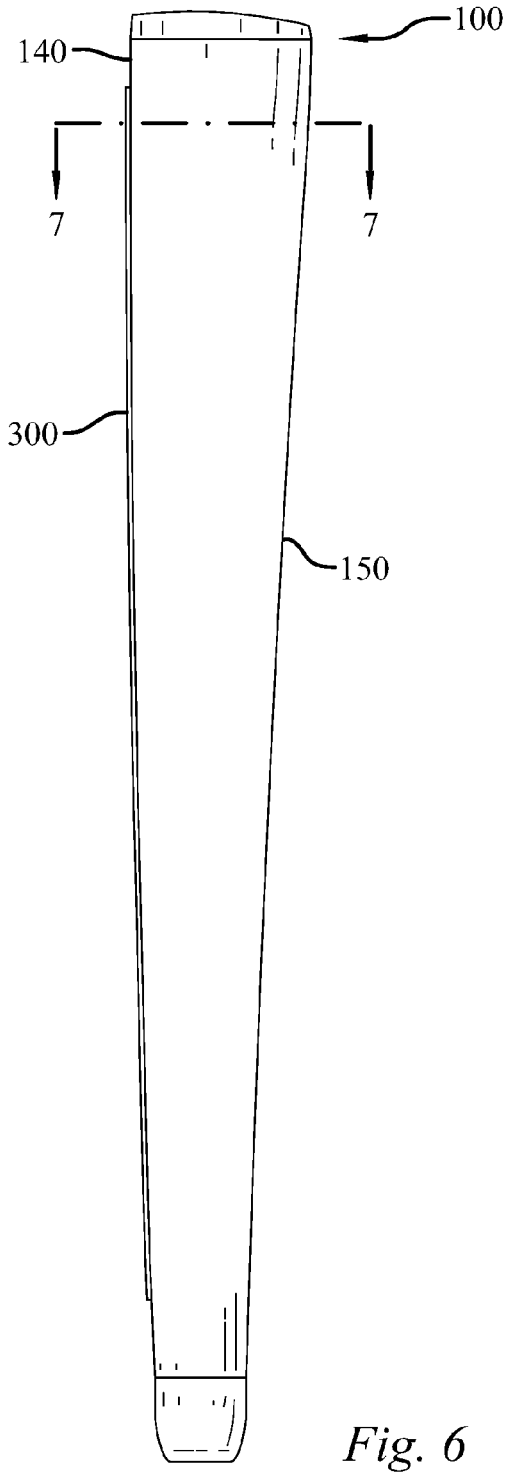
FIG. 6 is a side elevation view of an embodiment of a golf grip according to the present invention, not to scale.

With reference now to FIGS. 5 and 6, still another embodiment of the visual and tactile confirmation golf grip (100) according to the present invention is shown. The golf grip (100) generally has a grip length (110), a proximal end (120), a distal end (130), an anterior surface (140), and a posterior surface (150). It should be noted that the anterior surface (140) refers to the surface of a golf grip (100) that has been applied to a golf club that faces away from a golfer when the golf club is soled on a playing surface. The posterior surface (150) is directly opposite the anterior surface (140), and thus would face towards a golfer. For a golfer using a conventional grip, the golfer's thumbs will be positioned proximal to the anterior surface (140) of the golf grip (100) and the golfer's fingers will be wrapped around the posterior surface (150).

Still referring to FIG. 5, in a particular embodiment, the golf grip (100) includes an alignment projection (300). The alignment projection (300) extends longitudinally along the anterior surface (140), preferably along the longitudinal center of the anterior surface (140), a predetermined projection length (310). The alignment projection (300) also has a projection width (320) and a projection height (330), as best seen in FIG. 7.

Figure 7:
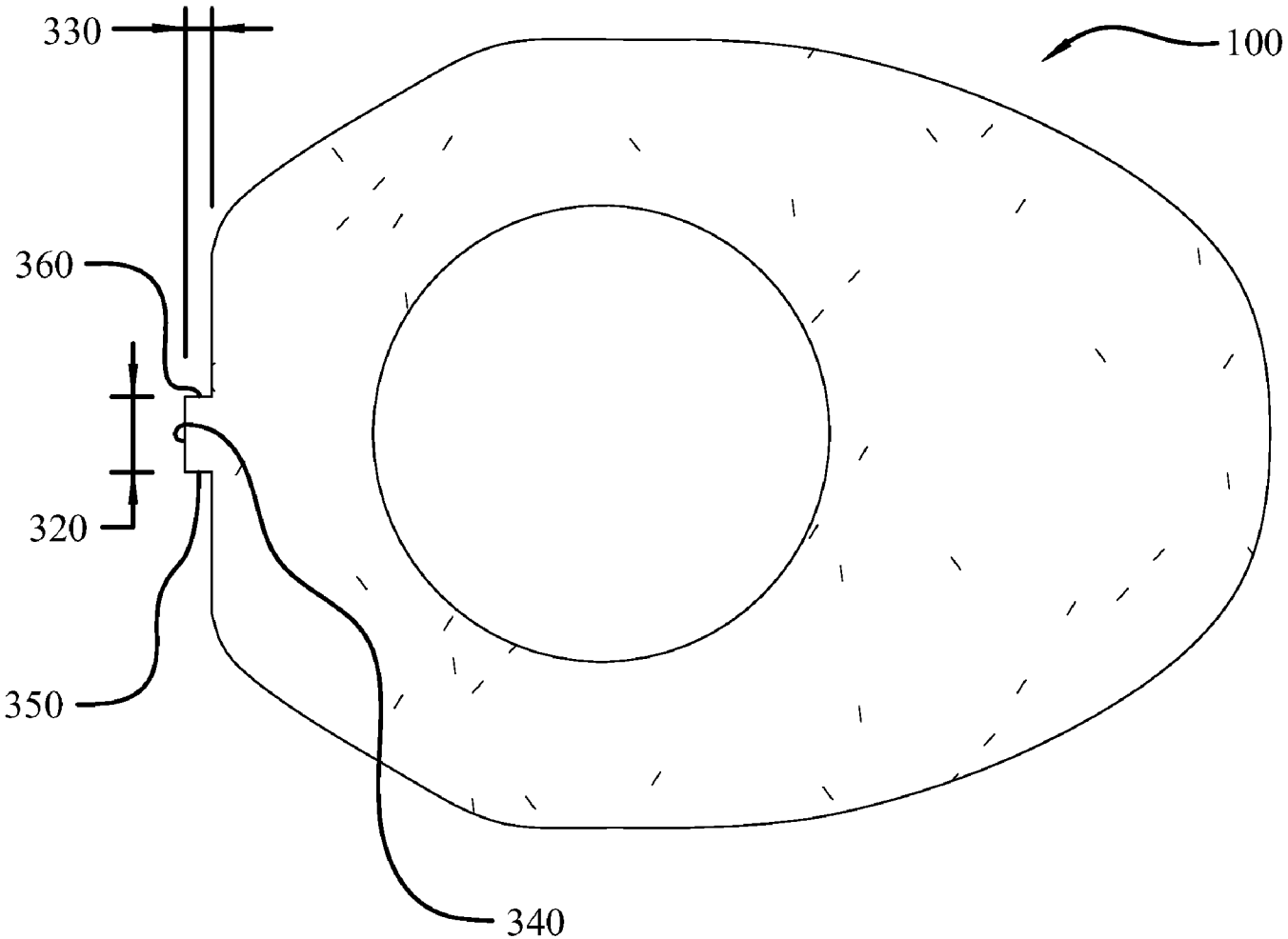
FIG. 7 is a cross-sectional view of the golf grip taken along section line 7-7 of FIG. 6, not to scale.
Figure 8:
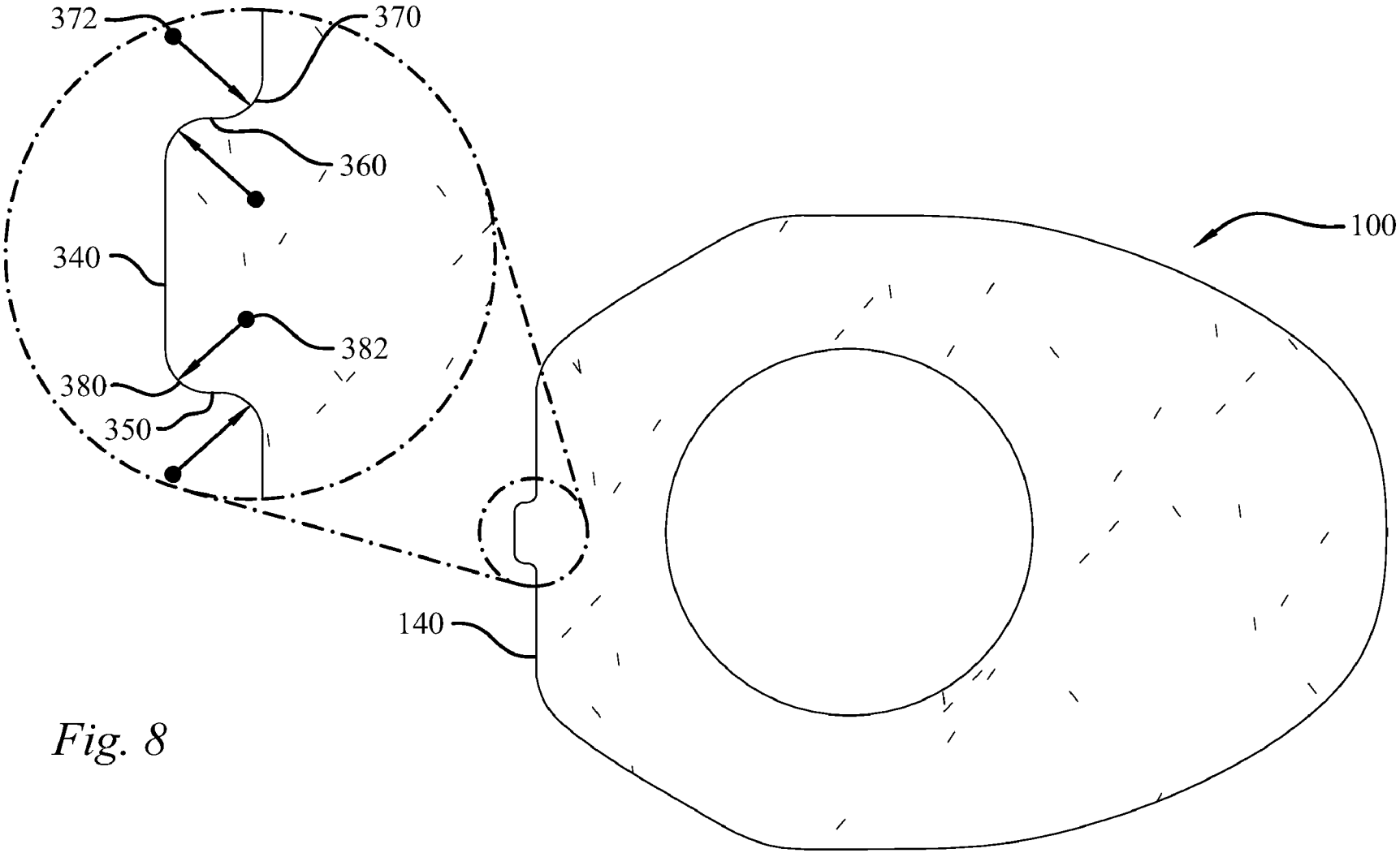
FIG. 8 is a cross-sectional view of an embodiment of a golf grip according to the present invention, not to scale.

Referring to FIG. 7, the alignment projection (300) is defined by a projection top wall (340), a projection dextral sidewall (350), and a projection sinistral sidewall (360). As seen in FIG. 8, the projection dextral sidewall (350) and the projection sinistral sidewall (360) are each joined to the anterior surface (140) by a lower projection transition region (370) having a lower projection transition region radius of curvature (372). Similarly, the projection dextral sidewall (350) and the projection sinistral sidewall (360) are each joined to the projection top wall (340) by an upper projection transition region (380) having an upper projection transition region radius of curvature (382).

In one particular embodiment, the projection width (320) is at least 1.5 millimeters, and the projection height (330) is at least 0.5 millimeters. Such dimensions accommodate two-point discrimination, and thus allow a golfer to determine by tactile perception the orientation of the golf grip (100) with respect to the golf club face (10). This feature is especially helpful when applying a golf grip (100) to a golf club as a way to confirm by feel that the golf grip (100) is free of any rotational deformity.

In another embodiment, the projection width (320) may between 1.5 millimeters and 3.0 millimeters, and the projection height (330) may be between 0.5 millimeter and 1.0 millimeter. Such dimensions accommodate two-point discrimination, which enables a golfer to determine by tactile perception the orientation of the golf grip (100) with respect to the golf club face (10).

Because the alignment projection (300) is configured and dimensioned to provide instant feedback as to whether the golf grip (100) is positioned correctly with respect to the golf club face (10), a golfer using the golf grip (100) will have more confidence when making a golf shot. Additionally, the feedback provided by the alignment projection (300) will instantly alert the golfer if the golf grip (100) ever becomes misaligned with respect to the golf club face (10).

Along similar lines, the upper projection transition region (380) and the upper projection transition region radius of curvature (382) also contribute to the ability of determining by tactile perception whether the golf grip (100) is accurately oriented with respect to the golf club face (10). In one embodiment, the upper projection transition region radius of curvature (382) is 0.35 millimeters or less. Such a dimension for the upper projection transition region radius of curvature (382) accommodates two-point discrimination by making the upper projection transition region (380) relatively fine and thus capable of distinction by feel. Preferably, the upper and lower projection transition region radius of curvature (382, 372) are equal to zero, which corresponds to the projection dextral and sinistral sidewalls (350, 360) each joining the projection top wall (340) at a 90 degree angle, and the projection dextral and sinistral sidewalls (350, 360) each joining the anterior surface (140) at a 90 degree angle. This specific embodiment provides a pair of distinct sharp edges that are raised above the anterior surface (140) that allows a golfer to confirm by feel whether the golf grip (100) is properly oriented with respect to the golf club face (10).

In addition to confirming by feel that the golf grip (100) is properly oriented with respect to the golf club face (10), the alignment projection (300) also provides a visual indication that the golf grip (100) is properly aligned. For example, in one embodiment, the projection top wall (340) may include visual indicia to distinguish the alignment projection (300) from the remainder of the golf grip (100). By way of example, and not limitation, the visual indicia may be a paint color that contrasts with the overall color of the grip, nylon sparkles, or a strip of reflective material.

In another embodiment, the projection dextral sidewall (350) and the projection sinistral sidewall (360) may include visual indicia. By way of example, and not limitation, the visual indicia may be bright paint colors that contrast with the overall color of the grip, nylon sparkles, or a strip of reflective material. The visual indicia on the projection dextral and sinistral sidewalls (350, 360) may function as a visual indicator and as a training aid. As a visual indicator, the visual indicia on the projection dextral and sinistral sidewalls (350, 360) provides visual feedback regarding whether the golf grip (100) is aligned with the golf club face (10) and whether the golf grip (100) is free of any rotational deformities. For example, if the golf grip (100) has a rotational deformity, a portion of the projection dextral or sinistral sidewall (350, 360) may be visible when looking down the golf grip (100) from a top view.

Furthermore, the visual indicia may also be utilized as a training aid. For example, when addressing a golf ball, a golfer may look down at the golf grip (100) to determine whether they have assumed a correct posture and have soled the golf club correctly. If the projection dextral and sinsitral sidewalls (350, 360) are visible, then the golfer may make adjustments to correct their posture and how the golf club is soled. When the projection dextral and sinistral sidewalls (350, 360) are no longer visible, then the golfer will know that they are addressing the golf ball correctly and will make their stroke with more confidence.

Additionally, the alignment projection (300) performs a "reminder" function. For example, when the golf grip (100) is applied properly with respect to the golf club face (10), a golfer will be able to feel the alignment projection (300) and know whether they are grasping the golf grip (100) with the proper hand and finger placement such that the golf club face (10) is properly aligned. The combination of knowing that the golf grip (100) was precisely aligned and the ability to perceive by feel that the golf grip (100) has been grasped correctly creates a higher level of psychomotor confidence in the golfer, which results in a better golf stroke.

In yet another embodiment of the instant invention, the projection length (310) is at least 50 percent of the grip length (110). Having the alignment projection (300) extend along at least 50 percent of the grip length (110) allows a golfer to determine, both visually and by feel, whether the golf grip (100) is at the desired orientation with respect to the golf club face (10), and especially whether the proximal end (120) and the distal end (130) are aligned and free of rotational deformity. Providing a shorter projection length (310) would allow for a greater possibility of optical illusion or misinterpretation when visually determining if the golf grip (100) is properly aligned. Additionally, a short projection length (310) would not provide an accurate indication as to the alignment of the proximal end (120) and the distal end (130) of the golf grip (100), and would likely result in the installed golf grip (100) having rotational deformities.

Moreover, an alignment projection (300) that extends along at least 50 percent of the grip length (110) accommodates the numerous styles of hand positioning and gripping used to grasp a golf club, especially a putter type golf club. Such a projection length (310) allows a golfer to always have both hands in contact with the alignment projection (300) to receive maximum feedback.

Figure 16:
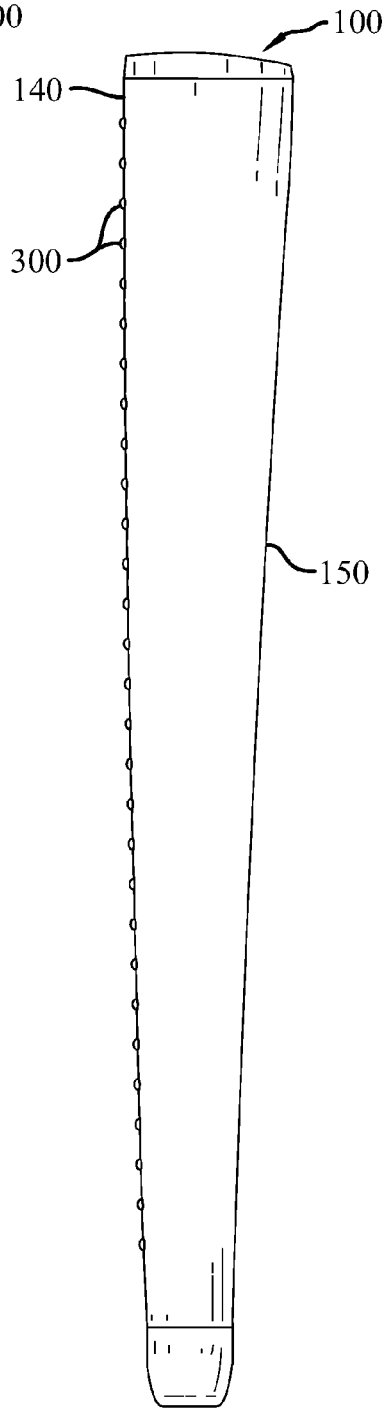
FIG. 16 is a side elevation view of an embodiment of a golf grip according to the present invention, not to scale.

In addition, the alignment projection (300) may comprise two or more non-continuous projections. The non-continuous projections may be strategically positioned on the golf grip (100) to coincide with the portions of the golf grip (100) most likely to be contacted by a golfer. In one embodiment, the non-continuous projections may be a series of braille-like dots, as seen in FIG. 16.

Although the visual and tactile confirmation golf grip (100) has been illustrated and described as having an alignment channel (200) or an alignment projection (300) extending longitudinally along the anterior surface (140), additional embodiments are contemplated. For example, in one particular embodiment, the golf grip (100) may include an alignment channel (200) extending longitudinally along the anterior surface (140) and an alignment projection (300) extending longitudinally along a posterior surface (150) of the golf grip (100). In this embodiment, a golfer may use the alignment channel (200) in connection with the alignment projection (300) to confirm with more precision that the golf grip (100) has been applied without rotational deformity and is in a desired orientation relative to the golf club face (10).

Figure 18:
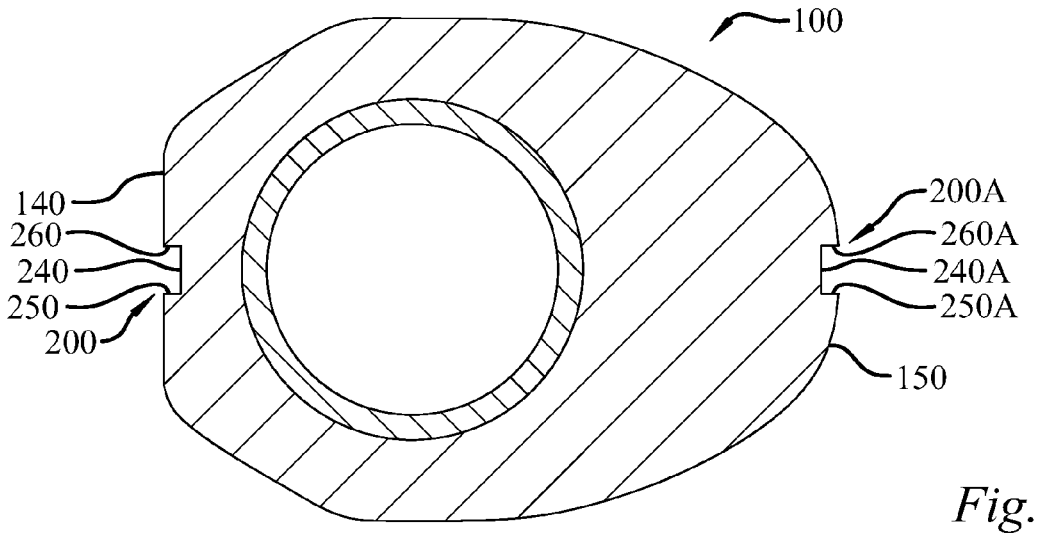
FIG. 18 is a cross-sectional view of an embodiment of a golf grip according to the present invention, not to scale.

Furthermore, the alignment projection (300) may be utilized as a "reminder" for proper hand and finger placement. One with skill in the art will appreciate that additional combinations of the alignment channel (200) and the alignment projection (300) on the anterior surface (140) and posterior surface (150) may be successfully employed, such as an alignment channel (200) on both the anterior and posterior surfaces (140, 150), as seen in FIG. 18, an alignment projection (300) on both the anterior and posterior surfaces (140, 150), or an alignment projection (300) on the anterior surface (140) and an alignment channel (200) on the posterior surface (150).

Figure 17:
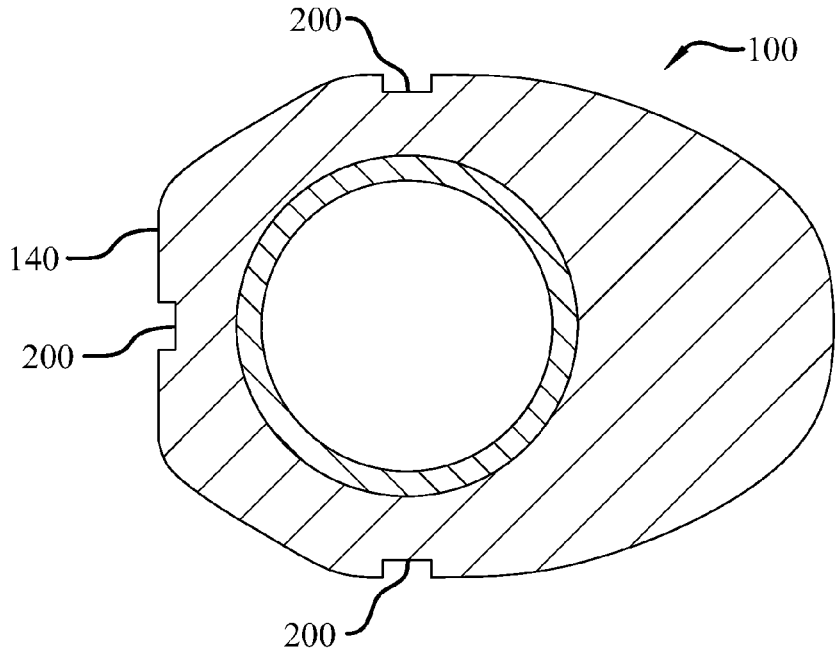
FIG. 17 is a cross-sectional view of an embodiment of a golf grip according to the present invention, not to scale.

In yet another embodiment, the golf grip (100) may further include an alignment channel (200) or an alignment projection (300) extending longitudinally along the side surfaces of the golf grip (100), as best seen in FIG. 17. In this embodiment, the alignment channel (200) or alignment projection (300) is configured to extend longitudinally along the areas of the golf grip (100) that will most likely be contacted by a golfer's fingertips. For example, a golfer using a conventional right-handed grip, or a left-handed golfer using a cross-handed grip, would contact the golf grip (100) at a lower left side portion of the golf grip (100) with their right hand fingertips, and they would contact the golf grip (100) at an upper right side portion of the golf grip (100) with their left hand fingertips. Thus, in one embodiment, the golf grip (100) may have an alignment channel (200) or an alignment projection (300) at a lower left side portion of the golf grip (100) and at an upper right side portion of the golf grip (100).

Conversely, a golfer using a conventional left-handed grip, or a right-handed golfer using a cross-handed grip, would contact the golf grip (100) at a lower right side portion of the golf grip (100) with their left hand fingertips, and they would contact the golf grip (100) at an upper left side portion of the golf grip (100) with their right hand fingertips. Thus, in another embodiment, the golf grip (100) may have an alignment channel (200) or an alignment projection (300) at a lower right side portion of the golf grip (100) and at an upper left side portion of the golf grip (100).

In yet another embodiment, the alignment channel (200) or an alignment projection (300) may extend longitudinally along at least 50 percent of the length of the side surfaces of the golf grip (100). This particular embodiment allows for a golfer's fingertips to be in contact with the alignment channel (200) or alignment projection (300) regardless of whether the golfer uses a conventional right-handed or left-handed grip.

By providing an alignment channel (200) or an alignment projection (300) along the side surfaces of the golf grip, the opportunity for the golfer's finger tips to contact the alignment channel (200) or alignment projection (300) is maximized. Since the fingertips are the most sensitive portion of the golfer touching the golf grip (100), the golfer's ability to determine by tactile perception the orientation of the golf grip (100) with respect to the golf club face (10) is likewise maximized. Repeated use of the golf grip (100) will build motor memory and will give the golfer more confidence that they are aligning the golf club face (10) correctly.

Figure 15:
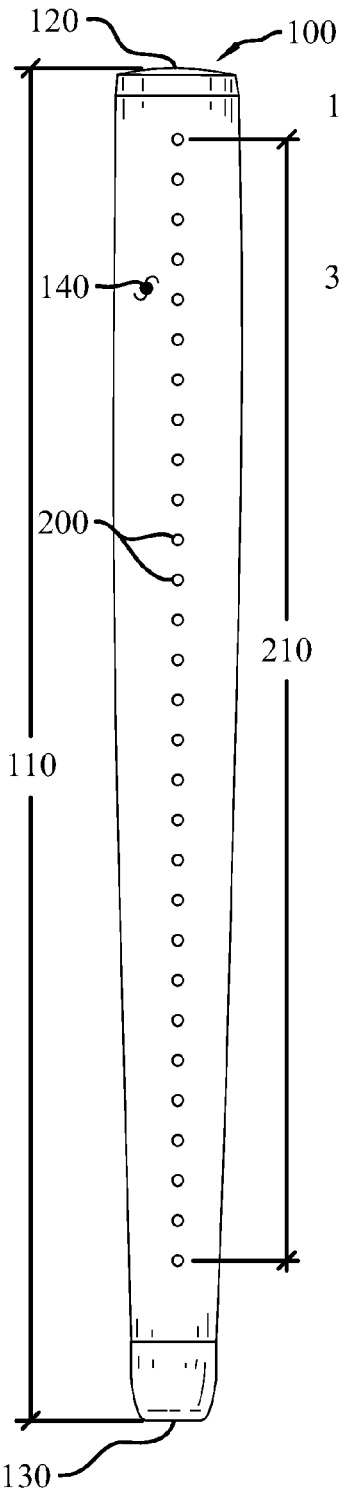
FIG. 15 is a front elevation view of an embodiment of a golf grip according to the present invention, not to scale.

Moreover, it is contemplated that additional geometries of the alignment channel (200) and the alignment projection (300) may be successfully utilized. By way of example, and not limitation, the alignment projection (300) may have a substantially circular cross-section, and the alignment channel (200) may have a U-shaped cross-section. In addition, the alignment channel (200) need not be a "channel" per se; rather, the alignment channel (200) may be configured as a series of small dimples or depressions that are continuous or non-continuous, as seen in FIG. 15.

The visual and tactile confirmation golf grip (100) of the instant invention may be produced from a variety of materials. By way of example only, and not limitation, the golf grip (100) may be constructed of any conventional grip material, such as natural rubber, synthetic rubber, polymers, elastomers, leathers, and combinations thereof. The golf grip (100), or a portion thereof, may also be constructed from a metal material such as aluminum or Nitinol. For example, the alignment channel (200) may comprise aluminum while the remainder of the golf grip (100) comprises an elastomer material.

The golf grip (100) according to the present invention may be manufactured utilizing traditional grip manufacturing processes. For example, the golf grip (100) may be produced by injection molding or extrusion molding. However, conventional grip molding techniques are limited in their ability to produce a golf grip (100) having an alignment channel (200) or alignment projection (300) with distinct sharp edges, i.e., zero radius edges. Therefore, the golf grip (100) according to the present invention may be formed by a molding process followed by a CNC machining process. Additionally, the golf grip (100) of the present invention may be produced by an advanced compression molding process, laser cutting, or a water jet. The golf grip (100) may be included as a part of an original equipment manufacturer's golf club. Additionally, the golf grip (100) may be available for purchase separately or as a part of a regripping kit.

Referring now to FIGS. 9-13, a system to confirm proper orientation of a golf grip (100) with respect to a golf club face (10) is illustrated. The system generally includes a golf grip (100) and an alignment device (400). Preferably, the golf grip (100) of the system is constructed according to one of the embodiments of the visual and tactile confirmation golf grip (100) as described above. However, the golf grip (100) may be any conventional grip.

As seen in FIGS. 9-12, in one particular embodiment of the system, the alignment device (400) is releasably secured to a visual and tactile confirmation golf grip (100) having an alignment channel (200). The alignment device (400) may be releasably secured to the golf grip (100) near a proximal end (120), as shown, near a distal end (130), or at any position on the golf grip (100). By way of example, and not limitation, the alignment device (400) may include hook and loop type fasteners, resilient clips, adjustable straps, or other types of fasteners to releasably secure the alignment device (400) to the golf grip (100).

Figure 9:
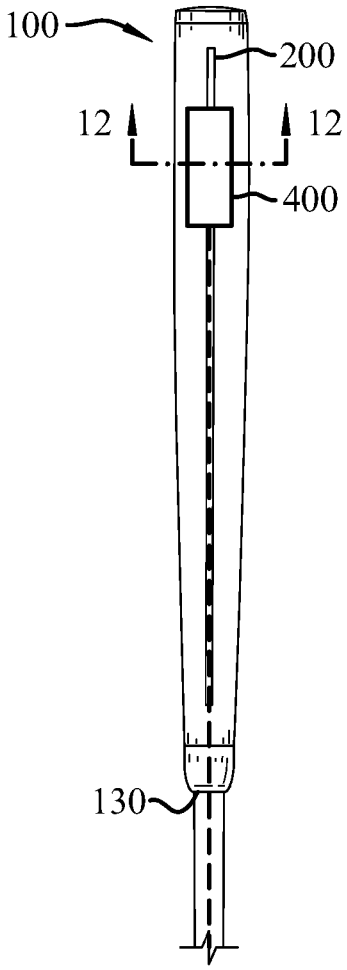
FIG. 9 is a front elevation view of an embodiment of a system to confirm proper orientation of a golf grip with respect to a golf club face according to the present invention, not to scale.
Figure 9:
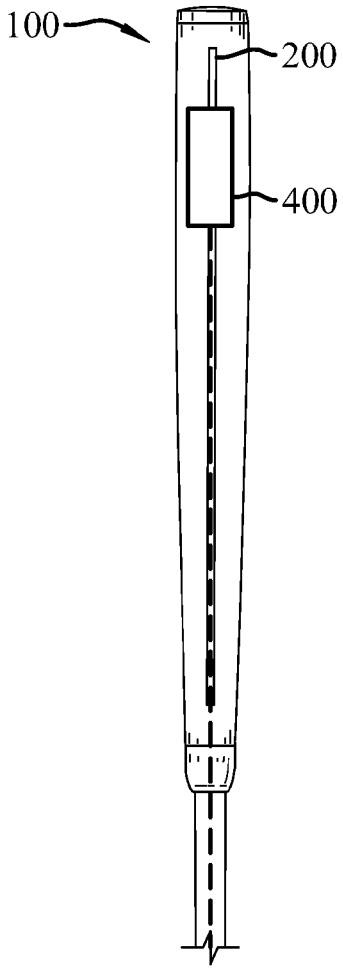
Figure 9:
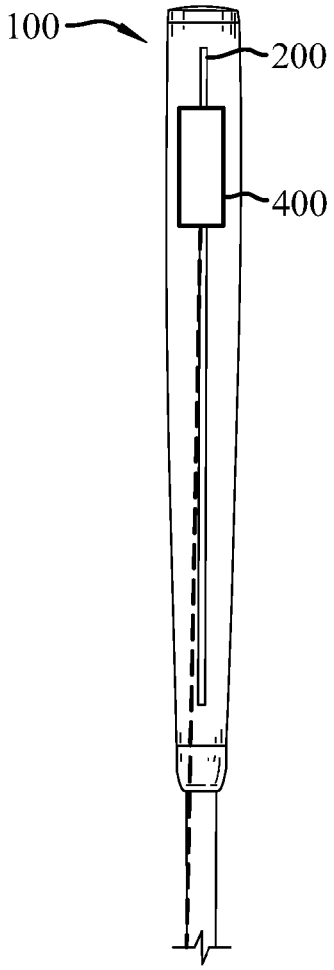
Figure 9:
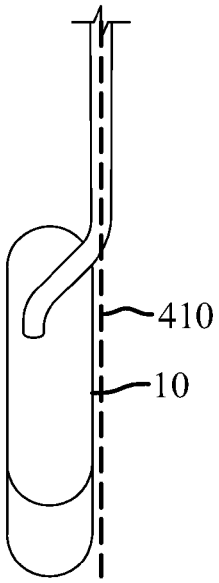
Figure 11:
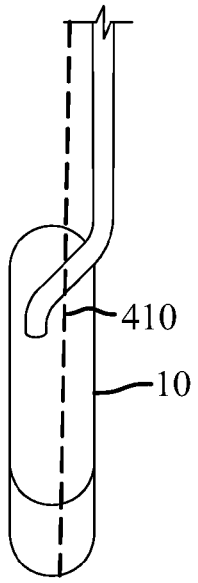
FIG. 11 is a front elevation view of an embodiment of a system to confirm proper orientation of a golf grip with respect to a golf club face according to the present invention, not to scale.

Referring now to FIG. 9, the alignment device (400) includes a feedback element (410) that projects along a straight line. With the alignment device (400) releasably secured and positioned on the golf grip (100), the golf grip (100) is adjusted such that the feedback element (410) and the alignment channel (200) are coincident to confirm that the golf grip (100) is free from rotational deformities. Failing to confirm that the feedback element (410) and the alignment channel (200) are coincident could result in the application of a twisted golf grip (100), as illustrated in FIG. 11.

In one particular embodiment, the feedback element (410) is a beam of laser light. The laser beam provides visual evidence that the golf grip (100) is aligned to the golf club face (10) in the desired orientation, or whether the golf grip (100) needs to be manipulated and adjusted to reach the desired orientation.

Figure 13:
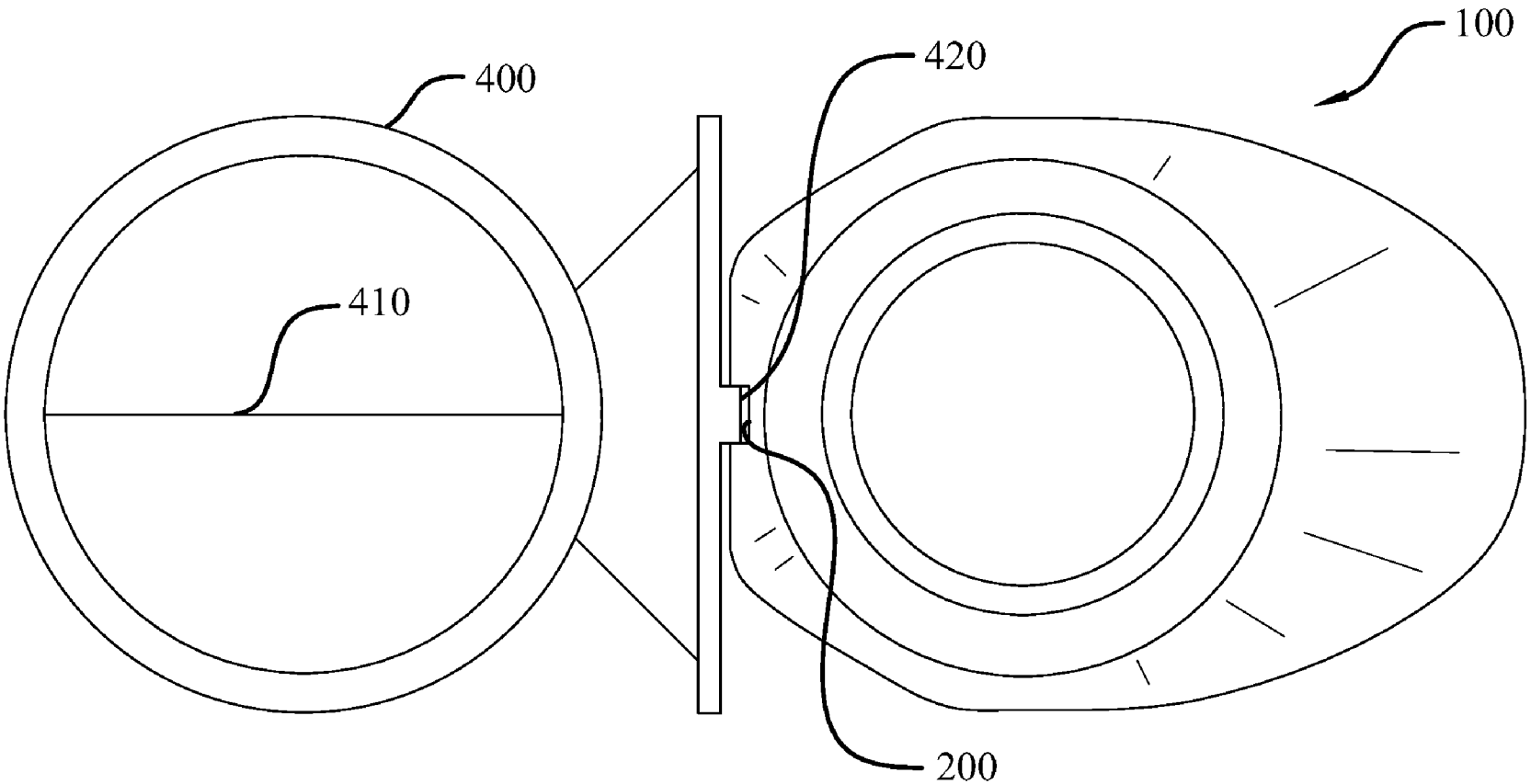
FIG. 13 is a top plan view of an embodiment of a system to confirm proper orientation of a golf grip with respect to a golf club face according to the present invention, not to scale.

In another embodiment, the feedback element (410) may be a reticle, as seen in FIG. 13. The reticle may be similar to a rifle scope, but would include only the vertical line of the crosshair. The reticle precisely indicates that the golf grip (100) is aligned in the desired orientation with respect to the golf club face (10), or whether the golf grip (100) requires adjustment to reach the desired orientation.

Figure 12:
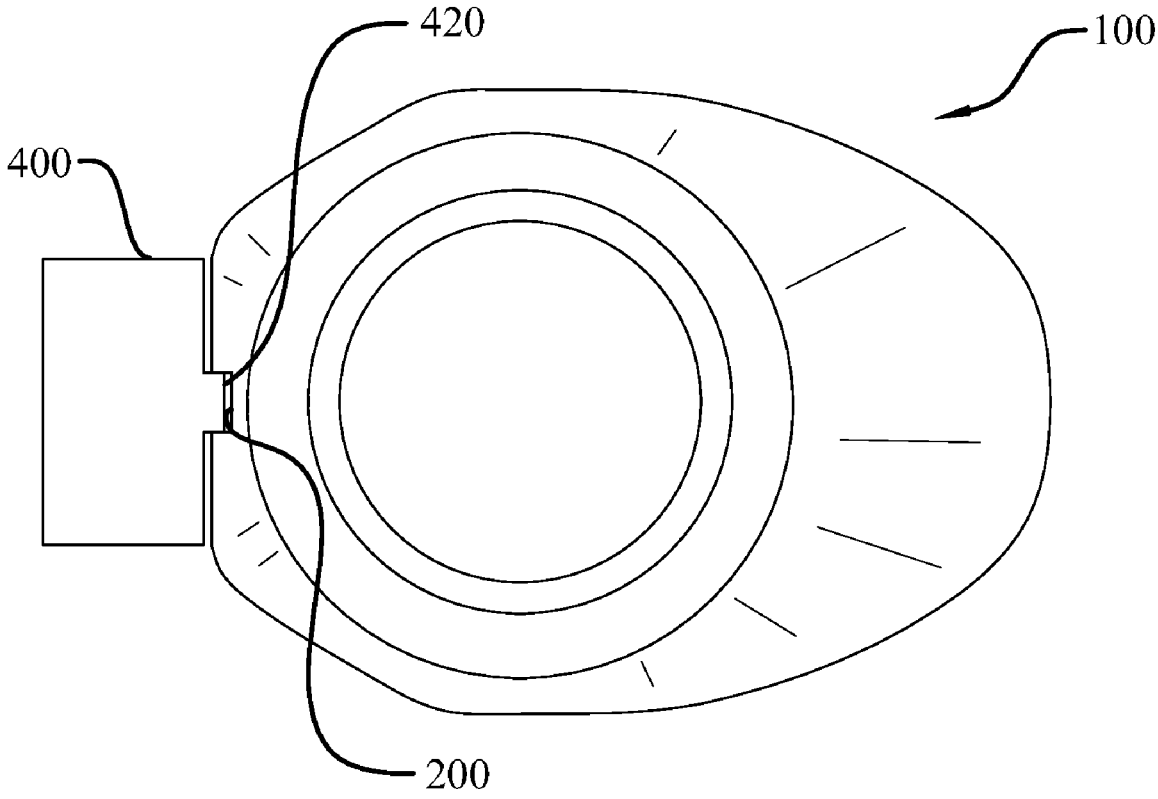
FIG. 12 is a cross-sectional view of the system taken along section line 12-12 of FIG. 9, not to scale.

In yet another embodiment, the alignment device (400) may include a positioning key (420) for cooperative engagement with the alignment channel (200), as best seen in FIG. 12. The positioning key (420) is configured to releasably secure the alignment device (400) by an interference fit in a predetermined position on the golf grip (100). Typically, the predetermined position will be along the longitudinal center of the anterior surface (140) for a more precise alignment. Likewise, for an embodiment utilizing a visual and tactile confirmation golf grip (100) having an alignment projection (300), the alignment device (400) may include a positioning keyway for cooperative engagement by an interference fit with the alignment projection (300).

After the alignment device (400) is releasably secured and positioned on the golf grip (100) and the feedback element (410) and the alignment channel (200) are aligned to be coincident with one another, the golf grip (100) may be adjusted until the feedback element (410) and the alignment channel (200) reach a desired position with respect to the golf club face (10). As seen in FIG. 9, the golf grip (100) has been adjusted such that the feedback element (410) and the alignment channel (200) are coincident and aligned parallel, or square, to the golf club face (10).

Figure 10:
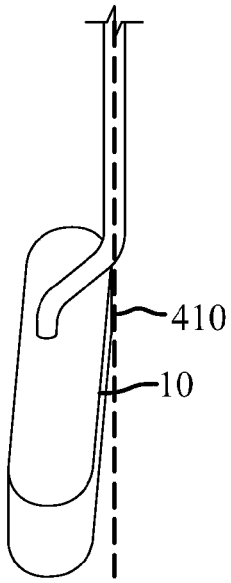
FIG. 10 is a front elevation view of an embodiment of a system to confirm proper orientation of a golf grip with respect to a golf club face according to the present invention, not to scale.

However, it should be noted that some golfers may prefer to have the golf club face (10) slightly diverge from the parallel alignment. For example, some golfers may have a tendency to close the golf club face (10) when making a stroke. These golfers would want a golf grip (100) installed such that the golf club face (10) is slightly open with respect to the feedback element (410) and the alignment channel (200), as seen in FIG. 10. The same principle would apply for those golfers who have a tendency to open the golf club face (10) when making a stroke. These golfers may prefer a golf grip (100) installed such that the golf club face (10) is slightly closed with respect to the feedback element (410) and the alignment channel (200).

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A visual and tactile confirmation golf grip (100) having a grip length (110), a proximal end (120), a distal end (130), an anterior surface (140), and a posterior surface (150), the golf grip (100) comprising:

only one alignment projection (300) extending longitudinally along the anterior surface (140) having a projection length (310), a projection width (320), and a projection height (330);

the alignment projection (300) defined by a projection top wall (340), a projection dextral sidewall (350), and a projection sinistral sidewall (360);

wherein the projection dextral sidewall (350) and the projection sinistral sidewall (360) are joined to the anterior surface (140) by a lower projection transition region (370), and the projection dextral sidewall (350) and the projection sinistral sidewall (360) are joined to the projection top wall (340) by an upper projection transition region (380) forming a corner;

wherein the alignment projection (300) is a visual and tactile indicator of the orientation of the golf grip (100) with respect to a golf club face and wherein said anterior surface is substantially flat in transverse and longitudinal directions of said grip.

2. The golf grip (100) according to claim 1, wherein the projection width (320) is at least 1.5 millimeters, and the projection height (330) is at least 0.5 millimeters.

3. The golf grip (100) according to claim 1, wherein the projection length (310) is at least 50 percent of the grip length (110).

4. The golf grip (100) according to claim 1, wherein the upper projection transition region (380) includes a right angle corner.

5. The golf grip (100) according to claim 1, wherein the upper projection transition region (380) corner is rounded.

6. The golf grip (100) according to claim 1, wherein the projection dextral sidewall (350) and the projection sinistral sidewall (360) each include visual indicia.

* * * * *